US009381989B1

(12) United States Patent
Poirier

(10) Patent No.: US 9,381,989 B1
(45) Date of Patent: Jul. 5, 2016

(54) SYSTEM AND METHOD FOR POSITIONING A DRIVE UNIT ON A MARINE VESSEL

(71) Applicant: Brunswick Corporation, Lake Forest, IL (US)

(72) Inventor: Brian J. Poirier, Fond du Lac, WI (US)

(73) Assignee: Brunswick Corporation, Lake Forest, IL (US)

( * ) Notice: Subject to any disclaimer, the term of this patent is extended or adjusted under 35 U.S.C. 154(b) by 136 days.

(21) Appl. No.: 14/177,767

(22) Filed: Feb. 11, 2014

Related U.S. Application Data

(60) Provisional application No. 61/782,908, filed on Mar. 14, 2013.

(51) Int. Cl.

| | |
|---|---|
| ***B60L 3/00*** | (2006.01) |
| ***B60L 15/00*** | (2006.01) |
| ***G05D 1/00*** | (2006.01) |
| ***G05D 3/00*** | (2006.01) |
| ***G06F 7/00*** | (2006.01) |
| ***G06F 17/00*** | (2006.01) |
| ***B63H 5/125*** | (2006.01) |
| ***B63H 5/08*** | (2006.01) |

(52) U.S. Cl.
CPC . *B63H 5/125* (2013.01); *B63H 5/08* (2013.01)

(58) Field of Classification Search
CPC ..... B63H 25/02; B63H 2025/465
See application file for complete search history.

(56) References Cited

U.S. PATENT DOCUMENTS 4,318,699 A 3/1982 Wenstadt et al.
4,565,528 A * 1/1986 Nakase ..... B63H 20/10 440/1
4,824,407 A 4/1989 Torigai et al.
4,861,292 A * 8/1989 Griffiths ..... B63H 21/21 440/1
4,872,857 A 10/1989 Newman et al.
4,898,563 A 2/1990 Torigai et al.
4,908,766 A 3/1990 Takeuchi
5,108,325 A * 4/1992 Livingston ..... B63H 5/125 440/112
5,118,315 A 6/1992 Funami et al.
5,263,432 A * 11/1993 Davis ..... B63B 39/061 114/286
5,352,137 A * 10/1994 Iwai ..... B63H 21/265 440/1
5,366,393 A * 11/1994 Uenage ..... B63H 20/10 440/1
5,385,110 A * 1/1995 Bennett . ..... B63B 39/061 114/285

(Continued)

OTHER PUBLICATIONS

Mercury Marine, Outboard Operation, Maintenance and Warranty Manual, May 2013, p. 21.

(Continued)

*Primary Examiner* — Adam Tissot
*Assistant Examiner* — Tommy Worden
(74) *Attorney, Agent, or Firm* — Andrus Intellectual Property Law, LLP

(57) ABSTRACT

A method for positioning a drive unit on a marine vessel includes receiving an initiation request from a user input device to operate the marine vessel in a desired operating mode and storing a first trim position of the drive unit in a memory upon receiving the initiation request. The method includes trimming the drive unit to a second trim position in response to the initiation request and subsequently operating the marine vessel in the desired operating mode with the drive unit in the second trim position. The method includes receiving a termination request to cancel the desired operating mode and trimming the drive unit to the first trim position automatically upon receiving the termination request. A system for positioning the drive unit is also disclosed.

23 Claims, 5 Drawing Sheets

(56) References Cited

U.S. PATENT DOCUMENTS 5,474,012 A * 12/1995 Yamada ..... B63B 39/061 114/286
5,474,013 A 12/1995 Wittmaier
5,785,562 A 7/1998 Nestvall
5,788,545 A 8/1998 Borgersen et al.
6,234,853 B1 5/2001 Lanyi et al.
6,273,771 B1 * 8/2001 Buckley ..... B63H 21/213 114/144 RE
6,354,237 B1 3/2002 Gaynor et al.
6,458,003 B1 10/2002 Krueger
6,904,341 B2 * 6/2005 Kish ..... G08G 3/00 342/352
6,994,046 B2 2/2006 Kaji et al.
6,997,763 B2 2/2006 Kaji
7,036,445 B2 * 5/2006 Kaufmann ..... B63B 39/061 114/144 RE
7,267,068 B2 9/2007 Bradley et al.
7,389,165 B2 * 6/2008 Kaji ..... B63H 20/08 440/1
7,416,456 B1 8/2008 Gonring et al.
7,467,595 B1 12/2008 Lanyi et al.
7,497,748 B2 * 3/2009 Salmon ..... B63B 39/061 114/285
7,530,866 B2 5/2009 Darby et al.
7,617,026 B2 11/2009 Gee et al.
7,958,837 B1 * 6/2011 Fraleigh ..... B63H 20/08 114/285
8,140,475 B1 * 3/2012 Sparks ..... G06F 11/1417 707/634
8,216,007 B2 * 7/2012 Moore ..... B63B 39/03 114/285
8,388,390 B2 * 3/2013 Kuriyagawa ..... B63H 20/10 440/1
8,428,799 B2 * 4/2013 Cansiani ..... B63B 39/061 114/285
8,622,777 B1 * 1/2014 McNalley ..... B63H 21/22 440/1
9,068,855 B1 * 6/2015 Guglielmo ..... G01C 21/36
2006/0281375 A1 * 12/2006 Jordan ..... B63H 3/04 440/38
2007/0089654 A1 * 4/2007 Bradley ..... B63H 25/42 114/10
2007/0089660 A1 * 4/2007 Bradley ..... B63H 25/42 114/144 A
2010/0235022 A1 * 9/2010 Siddappa ..... B61C 17/12 701/20
2010/0240267 A1 * 9/2010 Fukuoka ..... B63H 21/383 440/53
2011/0159752 A1 * 6/2011 Ota ..... B63H 11/11 440/41
2012/0318184 A1 * 12/2012 Morrison ..... B63B 13/00 114/125

OTHER PUBLICATIONS

Mercury Marine, Service Manual, Jul. 2013, p. 2A-S.

* cited by examiner

SYSTEM AND METHOD FOR POSITIONING A DRIVE UNIT ON A MARINE VESSEL

CROSS-REFERENCE TO RELATED APPLICATION

This application claims the benefit of U.S. Provisional Application No. 61/782,908, filed Mar. 14, 2013, which is hereby incorporated by reference in entirety.

FIELD

The present disclosure relates to marine vessels, and more particularly to systems and methods for controlling the trim angle of drive units on marine vessels.

BACKGROUND

The disclosure of U.S. Pat. No. 4,872,857 is hereby incorporated herein by reference and discloses systems for optimizing operation of a marine drive of the type whose position may be varied with respect to the boat by the operation of separate lift and trim/tilt means.

The disclosure of U.S. Pat. No. 7,416,456 is hereby incorporated herein by reference and discloses an automatic trim control system that changes the trim angle of a marine propulsion device as a function of the speed of the marine vessel relative to the water in which it is operated.

The disclosures of U.S. Pat. Nos. 6,234,853; 7,267,068; and 7,467,595 are hereby incorporated herein by reference and disclose methods and apparatuses for maneuvering multiple engine marine vessels.

The disclosure of U.S. Pat. No. 8,622,777 is hereby incorporated herein by reference and discloses systems and methods for maneuvering a marine vessel that limit interference by the hull of the vessel with reverse thrust. A marine propulsion device provides at least a reverse thrust with respect to the marine vessel. The propulsion device is vertically pivotable into a trim position wherein the hull does not impede or interfere with the reverse thrust. A control circuit controls the propulsion device to move into the trim position when the reverse thrust of the propulsion device is requested.

SUMMARY

This Summary is provided to introduce a selection of concepts that are further described below in the Detailed Description. This Summary is not intended to identify key or essential features of the claimed subject matter, nor is it intended to be used as an aid in limiting the scope of the claimed subject matter.

In one example disclosed herein, a method for positioning a drive unit on a marine vessel comprises receiving an initiation request from a user input device to operate the marine vessel in a desired operating mode and storing a first trim position of the drive unit in a memory upon receiving the initiation request. The method further comprises trimming the drive unit to a second trim position in response to the initiation request and subsequently operating the marine vessel in a desired operating mode with the drive unit in the second trim position. The method further comprises receiving a termination request to cancel the desired operating mode and trimming the drive unit to the first trim position automatically upon receiving the termination request.

In a further example, a system for positioning a drive unit of a marine vessel comprises a user input device that generates an initiation request to operate the marine vessel in a desired operating mode and a memory that stores a first trim position of the drive unit in response to the initiation request. A trim actuator trims the drive unit to a second trim position in response to the initiation request. A processor receives a termination request to cancel the desired operating mode, and upon receiving the termination request, the processor sends a control signal to the trim actuator to trim the drive unit to the first trim position.

BRIEF DESCRIPTION OF THE DRAWINGS

The present disclosure is described with reference to the following Figures. The same numbers are used throughout the Figures to reference like features and like components.

DETAILED DESCRIPTION

In the present description, certain terms have been used for brevity, clarity and understanding. No unnecessary limitations are to be inferred therefrom beyond the requirement of the prior art because such terms are used for descriptive purposes only and are intended to be broadly construed. The different methods and systems described herein may be used alone or in combination with other methods and systems.

Figure 1:
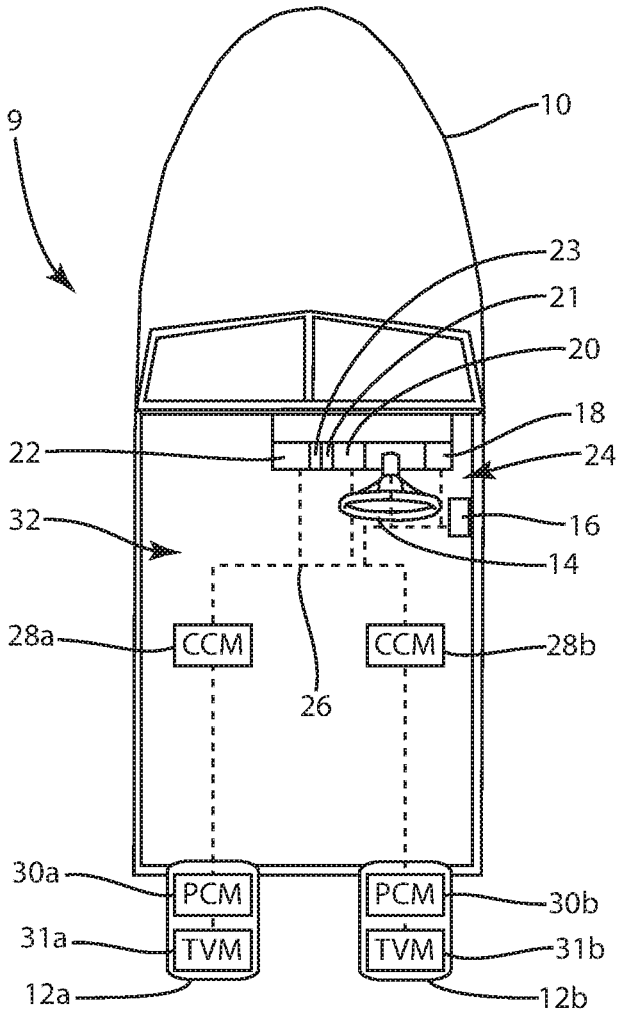
FIG. 1 is a schematic depiction of a marine vessel having a plurality of drive units and user input devices.

FIG. 1 schematically depicts a marine vessel 10 having a plurality of drive units 12*a*, 12*b*. In the example, the drive units 12*a*, 12*b* are port and starboard drive units respectively, and are shown coupled to the stern of the marine vessel 10. The drive units 12*a*, 12*b* shown herein are outboard motors, but could alternatively be pod drives or stern drives. The marine vessel 10 further comprises at least one user input device. In the example shown, the at least one user input device comprises a steering wheel 14, throttle lever 16, joystick 18, keypad 20, and/or touch screen 22. Each of these user input devices is located at a helm 24 of the marine vessel 10.

Each of the user input devices 14, 16, 18, 20, 22 is communicatively connected via a controller area network (CAN) bus 26 to a plurality of command control modules (CCMs) 28*a*, 28*b*. The CCMs 28*a*, 28*b* effectively receive and send all signals from and to the user input devices at the helm 24. The CCMs 28*a*, 28*b* are communicatively connected via the CAN bus 26 to a plurality of powertrain control modules (PCMs) 30*a*, 30*b* and thrust vector modules (TVMs) 31*a*, 31*b*. The PCMs 30*a*, 30*b* control functions of an engine provided in each drive unit 12*a*, 12*b*. The TVMs 31*a*, 31*b* control the direction of thrust of the drive units 12*a*, 12*b*. Together, each of the user input devices 14, 16, 18, 20, 22; the CCMs 28*a*, 28*b*; the PCMs 30*a*, 30*b*; and the TVMs 31*a*, 31*b* comprise portions of a control circuit 32 that controls various functions aboard the marine vessel 10, as will be more fully described herein below with reference to FIG. 5.

Now referring to FIGS. 2-4, various trim positions of the drive units 12*a*, 12*b* will be described. In the example shown in FIGS. 2-4, only the starboard drive unit 12*b* is shown. However, it should be understood that the port drive unit 12*a* is positioned in the same trim positions as the starboard drive unit 12*b* shown in these figures, and can therefore not be seen behind the starboard drive unit 12*b*. It should be understood that in alternative embodiments, the marine vessel 10 may be propelled by only one drive unit, or by more than two drive units. It should also be understood that in other examples, the two drive units 12*a*, 12*b* may have different trim positions from one another.

Figure 2:
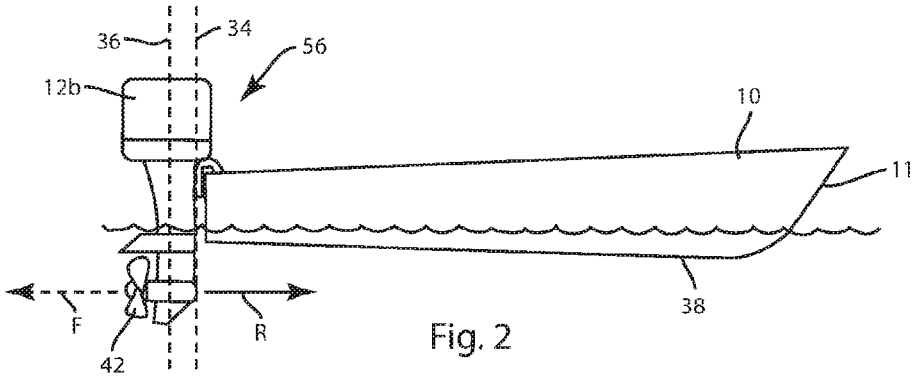
FIG. 2 is a side view of a marine vessel having a drive unit in a neutral trim position.
Figure 3:
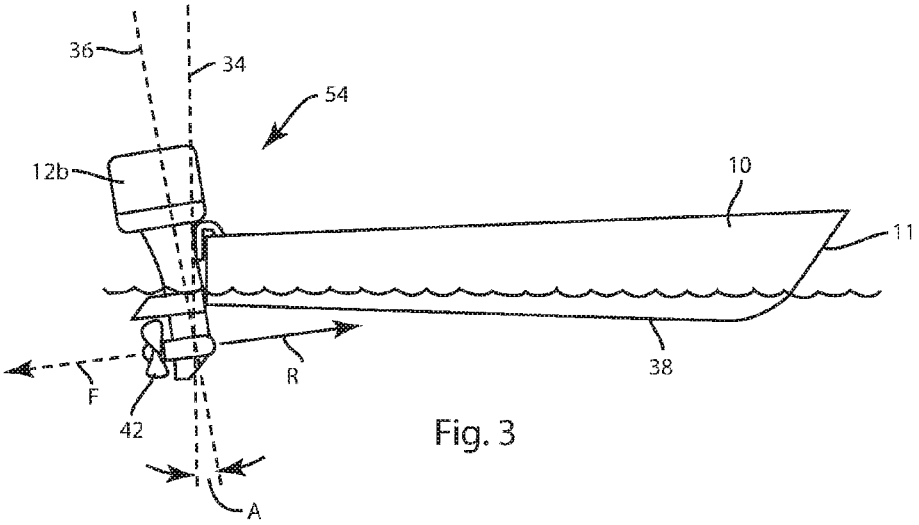
FIG. 3 is a side view of a marine vessel having a drive unit in a trimmed in position.
Figure 4:
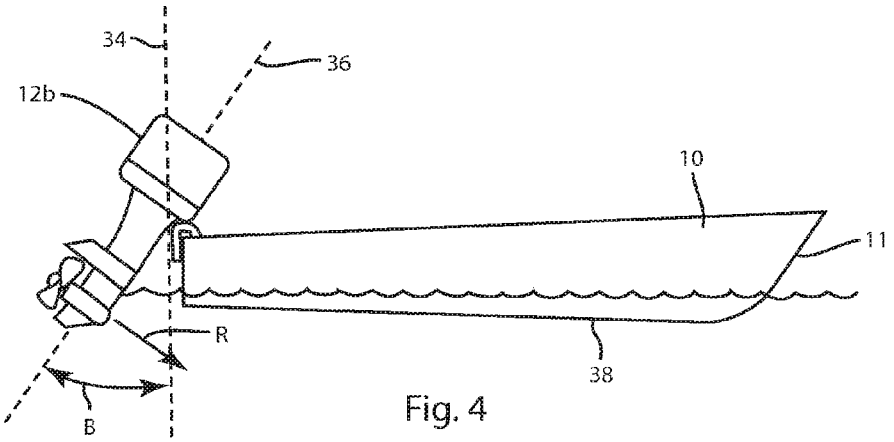
FIG. 4 is a side view of a marine vessel having a drive unit in a trimmed out position.

In each of FIGS. 2-4 the trim position of the drive unit 12*b* is shown with respect to a dashed line representing a vertical axis 34. Additionally, another dashed line in each of the figures represents a longitudinal axis 36 through the drive unit 12*b*. The angle between the vertical axis 34 and the longitudinal axis 36 is the trim angle. For example, the trim angle in FIG. 3 is labeled A, and the trim angle in FIG. 4 is labeled B. In FIG. 2, the drive unit 12*b* is in a neutral trim position in which the vertical axis 34 and the longitudinal axis 36 are generally parallel to one another. In FIG. 3, the drive unit 12*b* is trimmed in (trimmed down) such that a propeller 42 of the drive unit 12*b* is closer to a hull 38 of the marine vessel 10 than when the drive unit 12*b* is in the neutral trim position. In FIG. 4 the drive unit 12*b* is trimmed out (trimmed up) such that the propeller 42 is further from the hull 38 than when the drive unit 12*b* is in the neutral trim position.

FIG. 2 depicts the drive unit 12*b* in a neutral trim position, in which the drive unit 12*b* provides a reverse thrust that is not impeded by a hull 38 of the marine vessel 10. This neutral trim position is further described in U.S. Pat. No. 8,622,777, which was incorporated by reference hereinabove. In the example shown in FIG. 2, the trim angle of the drive unit 12*b* is such that a reverse thrust R provided by the drive unit 12*b* does not intersect with the hull 38 of the marine vessel 10 during any rotational orientation of the drive unit 12*b* about its longitudinal axis 36. Further, the trim angle of the drive unit 12*b* is such that reverse thrust R is not trimmed too far up away from the vertical axis 34 such that the drive unit 12*b* may still efficiently achieve reverse or rotational movement of the marine vessel 10. In the example of FIG. 2, the trim position (shown by longitudinal axis 36) is substantially parallel to the vertical axis 34.

The orientation of the longitudinal axis 36 of the drive unit 12*b* in FIG. 2 is an optional orientation, and in other examples, the drive unit 12*b* can be acutely or obtusely angled with respect to the vertical axis 34 and so avoid intersection with (and thus interference by) the hull 38. It should be understood that although a neutral trim position is shown here, the preferred trim position in which the reverse thrust R does not intersect with the hull 38 can vary and can be determined based, in part, upon the particular geometry of the hull 38 and the particular rotational angle of the drive unit 12*b* about its longitudinal axis 36. In general, the impact of the hull 38 on the reverse thrust R can be limited by angling the reverse thrust. Generally, however, the optimal trim position can be selected so as to provide the most effective utilization of thrust.

FIG. 3 shows the drive unit 12*b* in a trimmed in (trimmed down) position. This can be seen by comparison of the longitudinal axis 36 through the drive unit 12*b* with the vertical axis 34: in the trimmed in position, the drive unit 12*b* is angled such that the propeller 42 is closer to the hull 38 of the marine vessel 10 than when in the neutral position, and its longitudinal axis 36 is oriented at an angle A with respect to the vertical axis 34. Depending on the amount of the angle A, the reverse thrust R may engage with or intersect with the hull 38 of the marine vessel 10. Of course, this depends on the particular shape of the hull 38 and/or the rotational angle of the drive unit 12*b* about the longitudinal axis 36.

In FIG. 4, the drive unit 12*b* is shown in a trimmed out (trimmed up) position in which the propeller 42 is further from the hull 38 of the marine vessel 10 than when in the neutral position, and the longitudinal axis 36 extends at an angle B with respect to the vertical axis 34. This provides a reverse thrust R in a somewhat downwardly angled direction as shown.

The trimmed in position shown in FIG. 3 is a position that is conventionally used during initial forward acceleration (or launch) of the marine vessel 10 until full forward translation when the marine vessel 10 is on-plane. During such initial forward acceleration, the propeller 42 rotates forwardly to provide forward thrust (shown by dashed line F) to propel the marine vessel 10 forwardly. When the drive unit 12*b* is at this trim position for accelerating into forward translation of the marine vessel 10, the drive unit 12*b* provides forward thrust F that is angled somewhat downwardly.

Once the marine vessel 10 is in full forward translation and on-plane, the drive unit 12*b* is typically trimmed back out of the trim position shown in FIG. 3, past the vertical axis 34, and to a slightly raised (trimmed out) trim position, as shown in FIG. 4. This trimmed out position achieves, for example, optimal speed, fuel economy, or other desired performance characteristics.

Generally, once the marine vessel 10 is slowed to a stop, the trim angle of the drive units 12*a*, 12*b* does not change. In other words, the drive units 12*a*, 12*b* remain in the trimmed in position shown in FIG. 3 if the marine vessel 10 is slowed before it is on-plane and in full forward translation, or remain in the trimmed out position shown in FIG. 4 if the marine vessel 10 was slowed from full forward translation.

The trim position in FIG. 2 is considered an "optimal" trim position when it is anticipated that the drive units 12*a*, 12*b* will be creating reverse thrust R, as this position was selected to avoid intersection of the reverse thrust R with the hull 38 of the marine vessel 10. This occurs when the marine vessel is operating, for example, in one of three modes: (1) a reverse mode; (2) a joysticking mode; or (3) a station-keeping mode. In reverse mode, the drive units 12*a*, 12*b* produce reverse thrust R, as described hereinabove. Referring back to FIG. 1, reverse mode may be entered by movement of the throttle lever 16 into reverse gear. Joysticking mode may be entered in response to operator manipulation of the joystick 18. In joysticking mode, the operator can maneuver the joystick 18 away from vertical in order to cause the drive units 12*a*, 12*b* to rotate in different directions and to varying degrees. When the operator places the system in station-keeping mode, the marine vessel 10 maintains a user-desired heading and a user-desired global position. Station-keeping mode may be entered in response to activation of a station-keeping button 21 located on the keypad 20 or the touch screen 22. Both joysticking mode and station-keeping mode are more fully described in U.S. Pat. No. 8,622,777, which was incorporated by reference hereinabove, and will therefore not be described further herein.

Generally, both joysticking mode and station-keeping mode can be cancelled (exited) by movement of the throttle lever 16, which indicates that the operator wishes to place the engine in gear, and, for example, initiate launch of the marine vessel 10. Additionally, station-keeping mode can be cancelled by pushing the station-keeping button 21 on the keypad 20 or touch screen 22, after which the marine vessel 10 will no longer control the drive units 12*a*, 12*b* to maintain the marine vessel 10 at the user-desired heading and in the user-desired global position.

Figure 5:
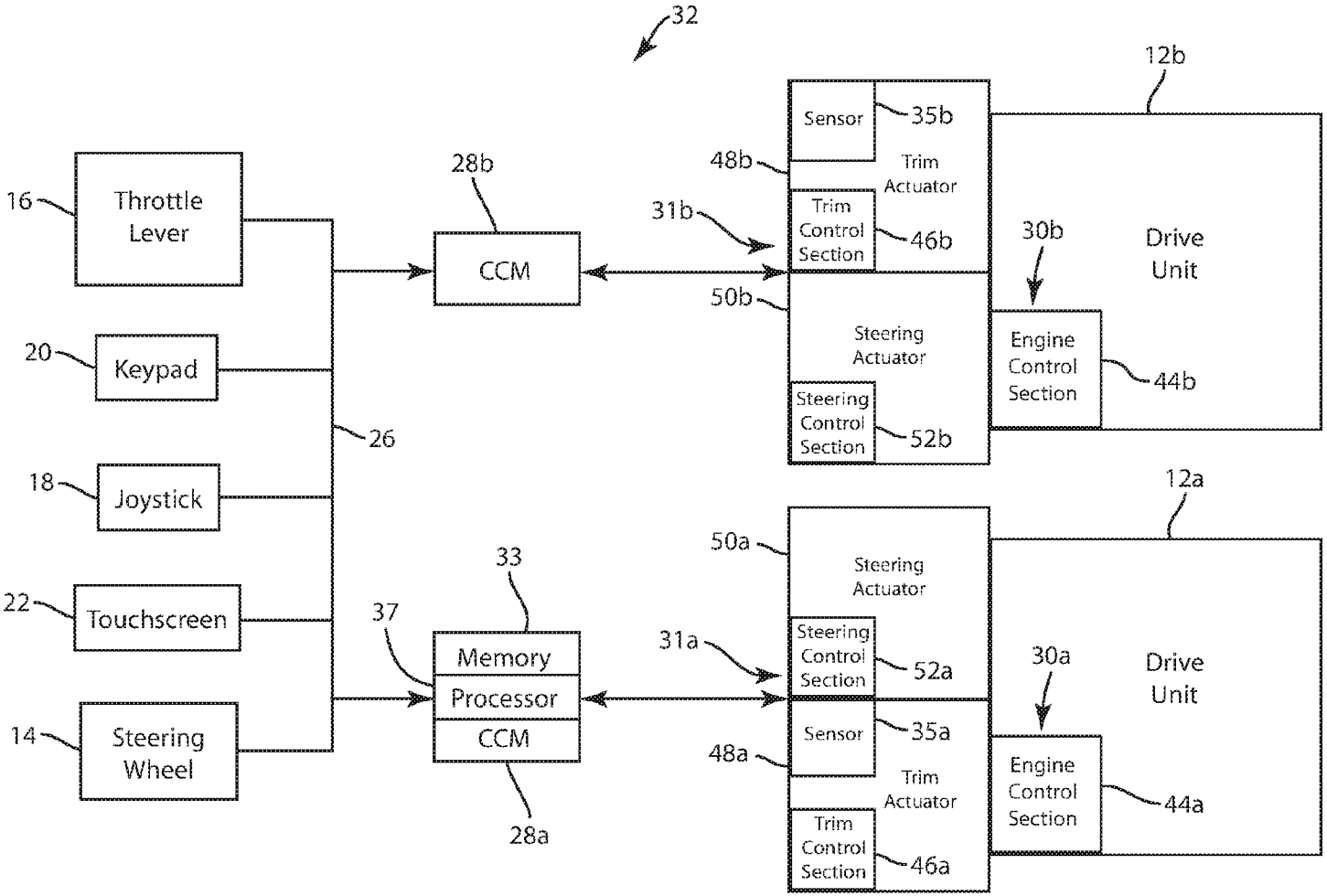
FIG. 5 is a schematic depiction of a control circuit for controlling a plurality of drive units.

FIG. 5 depicts a schematic representation of a control circuit 32 that can be used to position the drive units 12*a*, 12*b* on the marine vessel 10. As described hereinabove, the control circuit 32 comprises a throttle lever 16, keypad 20, joystick 18, touch screen 22, and steering wheel 14 (collectively, the user input devices) connected via a CAN bus 26 to CCMs 28*a*, 28*b*. It should be understood by those having skill in the art that a CAN bus need not be provided, and that these devices could instead be wirelessly connected (or connected by a different communication system) to one another and/or to the CCMs 28*a*, 28*b*. Further, the connections shown in dashed lines in both FIGS. 1 and 5 are for exemplary purposes only, and may be wired other than as shown herein.

Signals from each of the user input devices 14, 16, 18, 20, 22 are sent via the CAN bus 26 to helm control sections (in this example CCMs 28*a*, 28*b*), which interpret these signals and send commands to the a plurality of engine control sections 44*a*, 44*b*; trim control sections 46*a*, 46*b*; and steering control sections 52*a*, 52*b*. With reference to both FIGS. 1 and 5, in the example shown, the engine control sections 44*a*, 44*b* are located in the PCMs 30*a*, 30*b*, while the trim control sections 46*a*, 46*b* and steering control sections 52*a*, 52*b* are located in the TVMs 31*a*, 31*b*. The engine control sections 44*a*, 44*b* control the engines of each drive unit 12*a*, 12*b*, while the trim control sections 46*a*, 46*b* control trim actuators 48*a*, 48*b*. The trim actuators 48*a*, 48*b* move the drive units 12*a*, 12*b* to a requested trim position, in response to signals sent from the CCMs 28*a*, 28*b*, which signals are based on input from the user input devices. Also included in the control circuit 32 are steering actuators 50*a*, 50*b*. The steering actuators 50*a*, 50*b* steer the drive units 12*a*, 12*b* in response to signals sent from the CCMs 28*a*, 28*b* via the CAN bus 26 to steering control sections 52*a*, 52*b*. In the example shown, the CCMs, PCMs, and TVMs are illustrated as separate modules controlling separate functions aboard the marine vessel 10; however, it should be understood that any of the control sections shown and described herein could be provided in fewer modules or more modules than those shown.

Any of the CCMs, PCMs, and TVMs may have a memory and a programmable processor, such as processor 37 in CCM 28*a*. As is conventional, the processor 37 can be communicatively connected to a computer readable medium that includes volatile or nonvolatile memory upon which computer readable code (software) is stored. The processor 37 can access the computer readable code on the computer readable medium, and upon executing the code can send signals to carry out functions according to the methods described herein below. Execution of the code allows the control circuit 32 to control a series of actuators (for example steering actuators 50*a*, 50*b* and trim actuators 48*a*, 48*b*) of the drive units 12*a*, 12*b*. Processor 37 can be implemented within a single device but can also be distributed across multiple processing devices or sub-systems that cooperate in executing program instructions. Examples include general purpose central processing units, application specific processors, and logic devices, as well as any other type of processing device, combinations of processing devices, and/or variations thereof. The control circuit 32 may also obtain data from sensors aboard the vessel, and the processor 37 may save or interpret the data as described herein below. In the example shown, at least the port CCM 28*a* comprises a memory 33 (such as, for example, RAM or ROM), although the other control modules could be provided with a memory as well. Further, the control circuit 32 comprises trim angle sensors 35*a*, 35*b* for sensing current trim positions of the drive units 12*a*, 12*b* and providing this data to the control modules via the CAN bus 26.

As discussed above, the trim position shown in FIG. 3 is a trim position used for launch of the marine vessel 10. Generally, an operator of the marine vessel 10 will place the drive units 12*a*, 12*b* into this position when the operator wishes to initiate launch of the marine vessel 10. When the operator thereafter wishes to operate the marine vessel 10 in one of the three modes described above, namely, reverse mode, joysticking mode, and/or station-keeping mode, the drive units 12*a*, 12*b* can be automatically trimmed to the position shown in FIG. 2 in response to an initiation request for one of the desired operating modes. The systems and methods for providing such automatic trimming are fully described in U.S. Pat. No. 8,622,777 and will not be more fully described herein.

If the operator stops the marine vessel 10 after operating at faster speeds in open water, as mentioned above, the drive units 12*a*, 12*b* will remain in the trimmed up position of FIG. 4. If the operator thereafter initiates one of reverse, joysticking and/or station-keeping mode, the operator may receive an alert or prompt to trim the drive units 12*a*, 12*b* to the neutral trim position shown in FIG. 2. This feature requires acknowledgment from the operator before the drive units 12*a*, 12*b* are trimmed down. However, current systems and methods do not alert or prompt the operator that the drive units 12*a*, 12*b* remain in the neutral trim position of FIG. 2 upon cancellation one of these three modes, which can lead to an unexpected response of the marine vessel 10 upon launch, as discussed below.

It can be seen from comparison of FIGS. 2 and 3 that the trim position shown in FIG. 2 is relatively trimmed out in comparison to the trimmed in position shown in FIG. 3. Generally, when an operator is operating the marine vessel in one of reverse mode, joysticking mode, and/or station-keeping mode, he is operating at relatively slow speeds and would need to initiate launch before operating at faster speeds in open water. If the operator of the marine vessel 10 wishes to initiate launch of the marine vessel 10 after operating in one of the three modes mentioned hereinabove, he may forget that the drive units 12*a*, 12*b* have been automatically trimmed to the position shown in FIG. 2 according to the principles and methods described in U.S. Pat. No. 8,622,777, and may begin launch without first trimming the drive units 12*a*, 12*b* to the position of FIG. 3. Initiating launch while the drive units 12*a*, 12*b* are in the trim position shown in FIG. 2 may cause the bow 11 of the marine vessel 10 to unexpectedly rise out of the water as the operator of the marine vessel 10 engages the throttle lever 16 to propel the marine vessel 10 in a forward direction. When the bow 11 rises in such a manner, the marine vessel 10 may thereafter porpoise. Porpoising occurs when the bow 11 of the marine vessel 10 moves upwardly away from the surface of the water, and then back downwardly toward the surface of the water in a cyclic pattern. Through research and development, the present inventor has realized that this porpoising can be prevented by automatically trimming the drive units 12*a*, 12*b* back to the trim position shown in FIG. 3 when one of the three operating modes discussed hereinabove is canceled. By automatically returning the drive units 12*a*, 12*b* to the trimmed in position shown in FIG. 3, the marine vessel 10 will be prepared for launch upon cancellation of one of the reverse mode, joysticking mode, and/or station-keeping mode.

In one example, the trimmed in position of FIG. 3 is a first trim position 54 and the neutral trim position of FIG. 2 is a second trim position 56.

Figure 6:
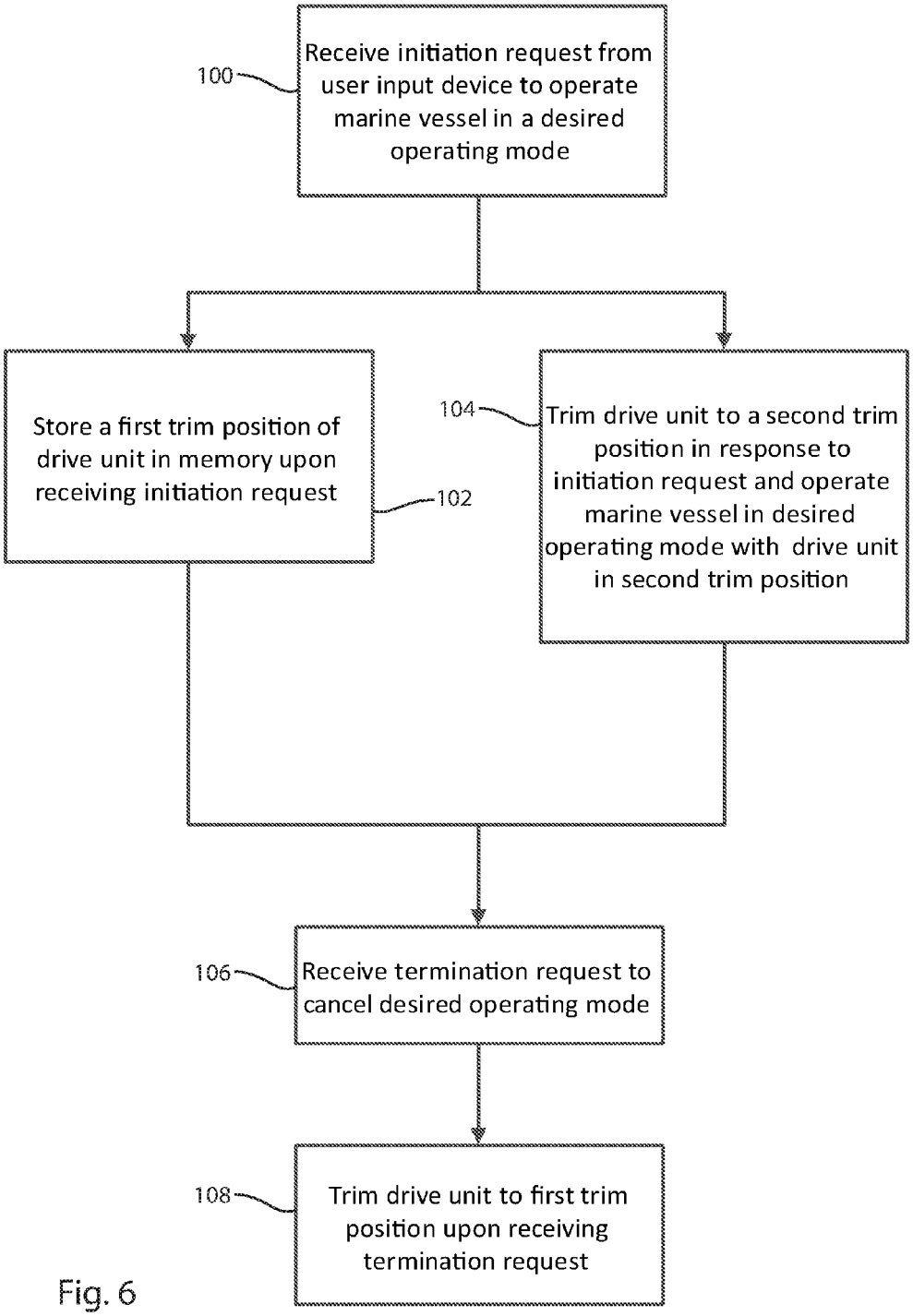
FIG. 6 is a flow chart depicting one example of a method for positioning a drive unit on a marine vessel.

Now with reference to FIG. 6, one example of a method for positioning the drive unit 12*a*, 12*b* on the marine vessel 10 will be described. As shown at 100, the method includes receiving an initiation request from a user input device to operate the marine vessel 10 in a desired operating mode. As discussed hereinabove, this operating mode may be one of a reverse mode, a joysticking mode, and/or station-keeping mode. When the desired operating mode is a joysticking mode, the user input device may be a joystick 18. When the desired operating mode is a station-keeping mode, the user input device may be a keypad 20 and/or touch screen 22. When the desired operating mode is a reverse mode, the user input device may be a throttle lever 16. Next, the method continues to 102, and includes storing a first trim position 54 of the drive unit 12*a*, 12*b* in a memory 33 upon receiving the initiation request. This storage can be done automatically upon receiving the initiation request, or in response to a prompt to the operator to select a "store" option via one of the user input devices at the helm 24. In one example, the first trim position 54 is a current trim position of the drive unit 12*a*, 12*b* when the initiation request is received. For example, the current trim position may be a trimmed in position as shown in FIG. 3. The current trim position may be input to the control circuit 32 by the trim angle sensors 35*a*, 35*b* and thereafter stored for later retrieval.

As shown at 104, while the first trim position 54 is stored in the memory (or before or after step 102) the method includes trimming the drive unit 12*a*, 12*b* to a second trim position 56 in response to the initiation request. The second trim position 56 may be the neutral trim position of FIG. 2, or another position that does not impede reverse thrust R of the drive unit 12*a*, 12*b*. The method includes subsequently operating the marine vessel 10 in the desired operating mode with the drive unit 12*a*, 12*b* in the second trim position 56.

After the operator has operated the marine vessel 10 in the desired operating mode for a period of time, the method continues with receiving a termination request to cancel the desired operating mode, as shown at 106. For example, when the desired operating mode is a joysticking mode, the termination request may be received in response to movement of the throttle lever 16. When the desired operating mode is a station-keeping mode, the termination request may be received in response to movement of the throttle lever 16 and/or in response to pressing of the station-keeping button 21 on the keypad 20 or the touch screen 22. When the desired operating mode is a station-keeping mode, the termination request may also be received in response to movement of the steering wheel 14 from a detent position in which the wheel is kept while the marine vessel 10 is in the station-keeping mode. This detent position can be thought of as a "zero" wheel position that is maintained despite accidental contact by the operator, but that can be purposefully steered away from in order to cancel the station-keeping mode. In some examples, when the desired operating mode is the joysticking mode or the station-keeping mode, the control circuit 32 may not interpret movement of the throttle lever 16 into reverse gear as a termination request, but may so interpret movement of the throttle lever 16 into forward gear. When the desired operating mode is a reverse operating mode, the termination request may be received in response to movement of the throttle lever 16 into neutral or forward gear. It should be understood that that there are many more ways to terminate one of the three desired operating modes, and the examples given herein are not limiting on the scope of the present disclosure.

The method continues, as shown at 108, by trimming the drive unit 12*a*, 12*b* to the first trim position 54 automatically upon receiving the termination request. Such movement places the drive unit 12*a*, 12*b* into a trim position that is optimal for launch of the marine vessel 10.

The method may further comprise trimming the drive unit 12*a*, 12*b* to a third trim position in response to pressing of a trim button 23, for example located at the keypad 20 or the touch screen 22 (FIG. 1). In one example, the third trim position is a trimmed up position, as shown in FIG. 4. This allows the operator to request a trim position that is higher than that associated with one of the three operating modes or that is higher than that the drive unit 12*a*, 12*b* was in when the operator initiated one of the three operating modes. In this case, the drive unit 12*a*, 12*b* will not return to the first trim position 54, but rather to an even higher requested trim position. Alternatively, the third trim position may be a trim position that is even more trimmed down than the position shown in FIG. 3. In this case, the drive unit 12*a*, 12*b* will not return to the first trim position 54, but rather to an even lower requested trim position.

Figure 7:
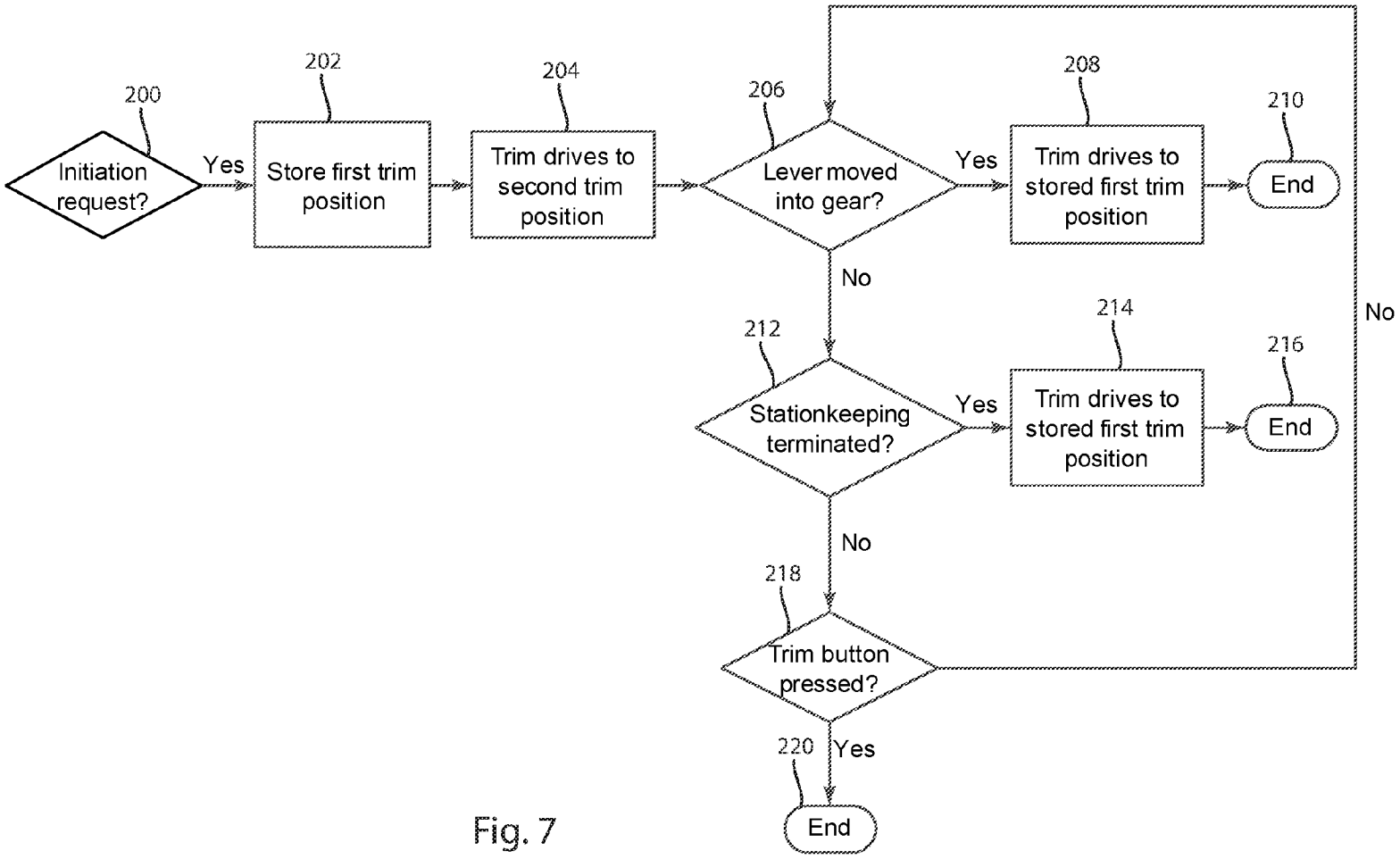
FIG. 7 is a flow chart depicting another example of a method for positioning a drive unit on a marine vessel.

FIG. 7 depicts an example of the logic (for example stored as computer readable code in the memory 33 of the CCM 28*a*) that the control circuit 32 carries out to perform the methods of the present disclosure. As shown at 200, the control circuit 32 determines whether there has been an initiation request to operate the marine vessel 10 in a desired operating mode. This initiation request is described hereinabove. If yes, the logic continues to 202, where the control circuit 32 stores the first trim position 54 in the memory 33. The first trim position 54 is thereafter a stored first trim position. Next, the control circuit 32 sends control signals to the trim actuators 48*a*, 48*b* to trim the drive units 12*a*, 12*b* to the second trim position 56, as shown at 204. The second trim position 56 is an optimal trim position for one of the three desired operating modes described hereinabove, namely reverse mode, joysticking mode, and/or station-keeping mode. At 206, the control circuit 32 makes a determination as to whether the throttle lever 16 has been moved into gear. If yes, the control circuit 32 interprets this as a termination request to cancel operation in the desired operation mode and continues to 208, where the control circuit 32 sends a signal to actuate the trim actuators 48*a*, 48*b* to trim the drive units 12*a*, 12*b* to the stored first trim position 54. The logic then ends at 210.

If at 206 the control circuit 32 instead determines that the throttle lever 16 has not been moved into gear, the logic continues to 212, where it determines whether station-keeping mode has been terminated. As discussed above, other than by movement of the throttle lever 16, station-keeping mode can also be terminated by pressing of the station-keeping button 21 on keypad 20 or the touch screen 22 and/or by movement of the steering wheel 14 from the detent position. If station-keeping mode has been terminated, the logic continues to 214 where the control circuit 32 sends a signal to actuate the trim actuators 48*a*, 48*b* to trim the drive units 12*a*, 12*b* to the stored first trim position 54. The logic then ends at 216.

If at 212 the control circuit 32 determines that station-keeping mode has not been terminated, the logic continues to 218 where it determines if the trim button 23, for example on the keypad 20 or touch screen 22, has been pressed. If no, the logic circles back to 206, where determinations are again made at 206 (whether the throttle lever 16 has been moved into gear) and 212 (whether station-keeping mode has been terminated by pressing of the station-keeping button 21 and/or by movement of the steering wheel 14 from the detent position). If the trim button 23 has been pressed, as determined at 218, the logic ends at 220. The trim actuators 48*a*, 48*b* are thereafter controlled to trim the drive units 12*a*, 12*b* to a third trim position corresponding to the trim position requested by pressing of the trim button 23.

With reference back to FIGS. 1 and 5, the present disclosure therefore contemplates a system 9 for positioning a drive unit 12*a*, 12*b* of a marine vessel 10. The system 9 comprises a user input device 16, 18, 20, 22 that generates an initiation request to operate the marine vessel 10 in a desired operating mode. A memory 33 stores a first trim position (FIG. 3) of the drive unit 12*a*, 12*b* in response to the initiation request. A trim actuator 48*a*, 48*b* trims the drive unit 12*a*, 12*b* to a second trim position (FIG. 2) in response to the initiation request. A processor 37 receives a termination request to cancel the desired operating mode, and upon receiving the termination request, sends a control signal to the trim actuator 48*a*, 48*b* to trim the drive unit 12*a*, 12*b* to the first trim position (FIG. 3).

In the above description, certain terms have been used for brevity, clarity, and understanding. No unnecessary limitations are to be inferred therefrom beyond the requirement of the prior art because such terms are used for descriptive purposes and are intended to be broadly construed. The different systems and method steps described herein may be used alone or in combination with other systems and methods. Further, any reference to drive units in the plural applies equally to two drive units as shown herein, to one drive unit, or to more than two drive units. It is to be expected that various equivalents, alternatives and modifications are possible within the scope of the appended claims. Each limitation in the appended claims is intended to invoke interpretation under 35 U.S.C. §112(f), only if the terms "means for" or "step for" are explicitly recited in the respective limitation.

What is claimed is:

1. A method for positioning a drive unit on a marine vessel, the method comprising:

receiving an initiation request from a user input device to operate the marine vessel in a desired operating mode in which it is anticipated that the drive unit will provide a reverse thrust;

storing a first trim position of the drive unit in a memory upon receiving and in response to the initiation request;

trimming the drive unit to a second trim position automatically in response to the initiation request and subsequently operating the marine vessel in the desired operating mode with the drive unit in the second trim position, wherein the second trim position is a trim position in which the reverse thrust is not impeded by a hull of the marine vessel;

receiving a termination request to cancel the desired operating mode; and trimming the drive unit to the first trim position automatically upon receiving the termination request.

2. The method of claim 1, wherein the first trim position is a current trim position of the drive unit when the initiation request is received.

3. The method of claim 2, wherein the current trim position is a trimmed in position.

4. The method of claim 1, wherein the second trim position is a neutral trim position.

5. The method of claim 1, wherein the user input device is a joystick and the desired operating mode is a joysticking mode.

6. The method of claim 5, further comprising receiving the termination request in response to movement of a throttle lever.

7. The method of claim 1, wherein the user input device is a keypad and the desired operating mode is a station-keeping mode.

8. The method of claim 7, further comprising receiving the termination request in response to movement of a throttle lever.

9. The method of claim 7, further comprising receiving the termination request in response to pressing of a station-keeping button on the keypad.

10. The method of claim 1, further comprising trimming the drive unit to a third trim position in response to pressing of a trim button.

11. A system for positioning a drive unit of a marine vessel, the system comprising:

a user input device that generates an initiation request to operate the marine vessel in a desired operating mode in which it is anticipated that the drive unit will provide a reverse thrust;

a memory that stores a first trim position of the drive unit in response to the initiation request;

a trim actuator that trims the drive unit to a second trim position automatically in response to the initiation request; and a processor that receives a termination request to cancel the desired operating mode;

wherein, in response to receiving the termination request, the processor sends a control signal to the trim actuator to trim the drive unit to the first trim position.

12. The system of claim 11, wherein the first trim position is a current trim position of the drive unit when the initiation request is generated.

13. The system of claim 12, further comprising a trim position sensor for sensing the current trim position of the drive unit.

14. The system of claim 12, wherein the current trim position is a trimmed in position.

15. The system of claim 11, wherein the second trim position is a trim position in which the reverse thrust is not impeded by a hull of the marine vessel.

16. The system of claim 15, wherein the second trim position is a neutral trim position.

17. The system of claim 11, further comprising a throttle lever, wherein the termination request is generated in response to movement of the throttle lever.

18. The system of claim 17, wherein the user input device is a keypad and the desired operating mode is a station-keeping mode.

19. The system of claim 17, wherein the user input device is a joystick and the desired operating mode is a joysticking mode.

20. The method of claim 1, further comprising automatically storing the first trim position in the memory in response to receiving the initiation request.

21. The method of claim 1, further comprising automatically generating a user prompt to store the first trim position in the memory in response to receiving the initiation request.

22. The system of claim 11, wherein the memory automatically stores the first trim position in response to the initiation request.

23. The system of claim 11, wherein, in response to the initiation request, the processor automatically generates a user prompt to store the first trim position in the memory.

* * * * *